United States Patent [19]

Rutherford

[11] 4,411,558

[45] Oct. 25, 1983

[54] ROOF SUPPORT SUITABLE FOR USE IN MINES

[75] Inventor: Dennis F. Rutherford, Cheltenham, England

[73] Assignee: Dowty Mining Equipment Limited, England

[21] Appl. No.: 318,218

[22] Filed: Nov. 4, 1981

[30] Foreign Application Priority Data

Nov. 26, 1980 [GB] United Kingdom ..... 8037937

[51] Int. Cl.[3] ..... E21D 15/44; E21D 17/05

[52] U.S. Cl. ..... 405/294

[58] Field of Search ..... 405/291, 293, 294, 295, 405/296

[56] References Cited

U.S. PATENT DOCUMENTS 3,877,234 4/1975 Martinko et al. .

3,889,475 6/1975 Allen .

4,217,067 8/1980 Lagodka et al. .

*Primary Examiner*—David H. Corbin

*Attorney, Agent, or Firm*—Hayes, Davis & Soloway

[57] ABSTRACT

A roof support including a roof-engageable member and a cantilever member, one having parallel elongate compartments with a cover member which has a roof-engageable surface and which overlies the compartments, and the other having parallel and rigid elongate elements slidably fitting into the compartments. The other member also includes a plate, having a roof-engageable surface, which defines the profile in plan of that member and which is so secured to the elements as to be relatively slidable with respect to the roof-engageable surface of the cover member. The transverse widths of the roof-engageable surfaces are such that when the roof-engageable member and the cantilever member are caused by actuator means relatively to slide from a retracted condition to an extended or partially-extended condition one of those surfaces effectively forms a full width extension of the other.

9 Claims, 6 Drawing Figures

ROOF SUPPORT SUITABLE FOR USE IN MINES

Figure 1:
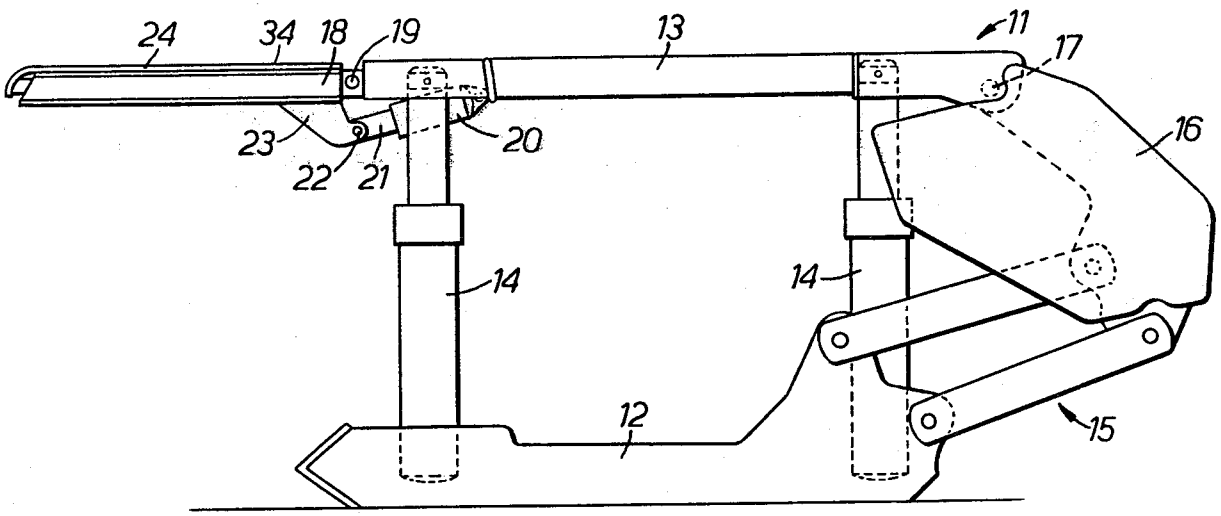

This invention relates to a roof support suitable for use in mines for supporting the mine roof during mineral-mining operations.

Certain of such mine roof supports include a floor-engaging structure, extendable and contractible prop means carried by said floor-engaging structure, a roof-engageable member supported by the prop means, and a cantilever member which is extendable and retractable with respect to said roof-engageable member by actuator means and which when extended is capable of providing for mine roof support between the roof-engageable member and the mineral face.

The roof-engageable member may comprise a main roof beam and an extension member connected thereto, for example by pivotal means, and urged by capsule means into supporting engagement with the mine roof, a cantilever member being so carried by that extension member as to be extendable and retractable with respect thereto.

Hitherto difficulty has been experienced with such cantilever members in that due to their somewhat large overall depth they have been heavy and unwieldy, in that they have often had inadequate roof-engaging area, and in that their bearing support has been inadequate with the result that desired smooth sliding operation upon extension and retraction has not been obtained.

The invention as claimed is intended to provide a remedy. It solves the problem of how to design an improved roof support, the cantilever member of which is of compact construction, is provided with a relatively large roof-supporting area, and has adequate bearing support so as to be afforded smooth sliding operation.

According to the invention a roof support suitable for use in mines includes a roof-engageable member and a cantilever member, one of these two members comprising a base, a cover member providing a roof-engageable surface, and a plurality of longitudinal members secured, in parallel manner, both to said base and said cover member, whereby said base, cover member and longitudinal members together form a plurality of parallel elongate compartments extending in the lengthwise direction of the cover member, and the other of said two members including a plurality of parallel and rigid elongate elements slidably fitting into said compartments and joined together at least at their end portions remote from said one member, said other member also including a plate, having a roof-engageable surface, which defines the profile in plan of that member and which is so secured to said elements, in parallel relation therewith, as to be relatively slidable upon and with respect to said roof-engageable surface of said cover member, the transverse widths of said surfaces being such that when said members are caused by actuator means relatively to slide from a retracted condition to an extended condition, or to a partially-extended condition, one of said roof-engageable surfaces effectively forms a full width extension of the other of said roof-engageable surfaces.

Preferably said one member having the plurality of parallel elongate compartments forms said roof-engageable member and said other member having the plurality of elongate elements forms said cantilever member.

The provision of such sliding support for the cantilever member by virtue of said elements cooperating with said compartments and said plate cooperating with said roof-engageable surface of said cover member results in a construction which is relatively small in overall depth and yet which affords adequate rigidity for accommodating the mine roof loads to which the cantilever member is subjected during mineral-mining operations. Further the roof-engageable plate of the cantilever member provides a complete cover for the member thereby affording a roof-engageable surface of relatively large area and affording adequate protection against the ingress of mineral debris into the components of the structure.

Figure 2:
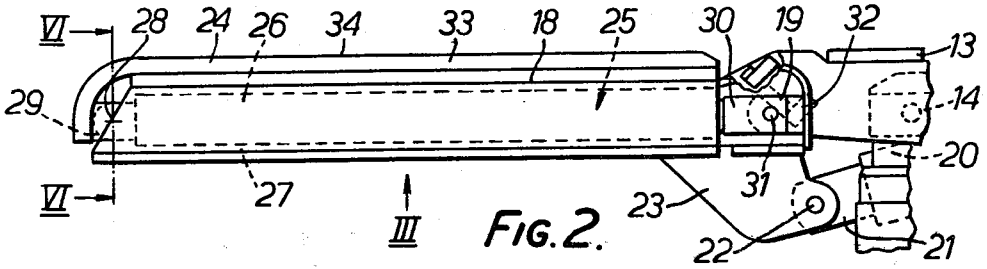
Figure 3:
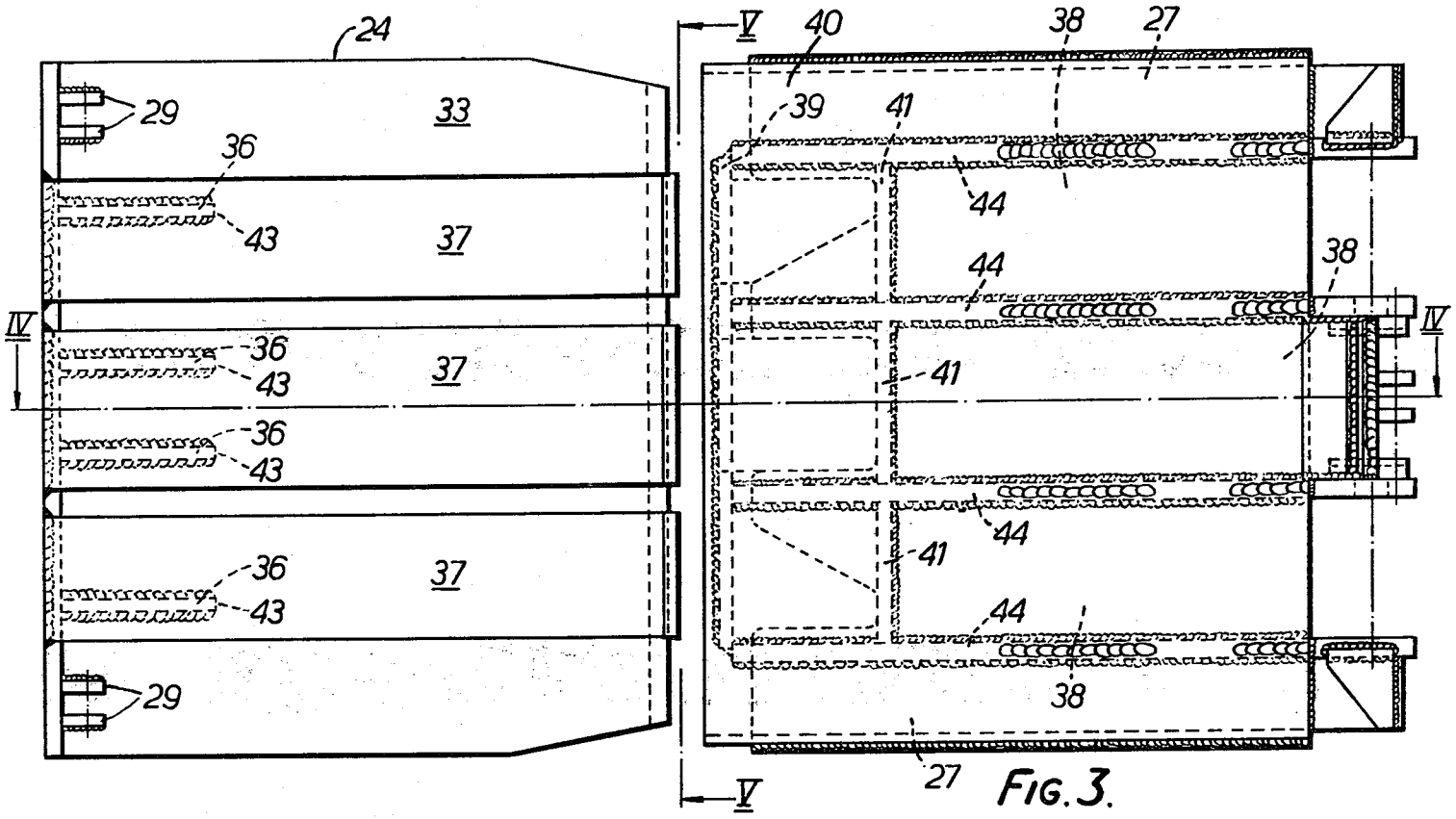
Figure 4:
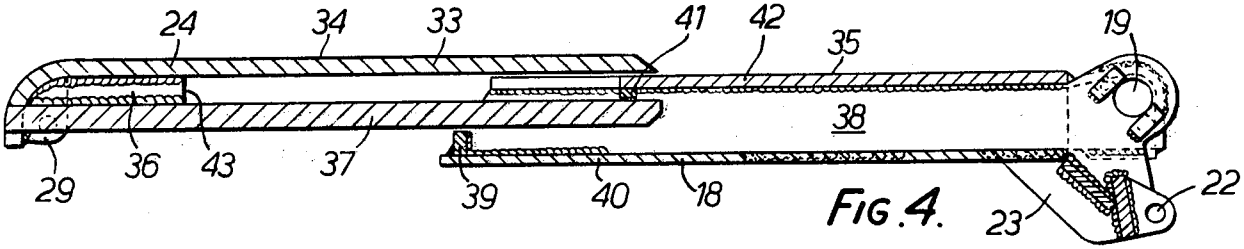
Figure 5:
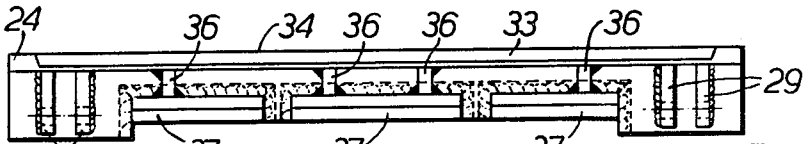
Figure 6:
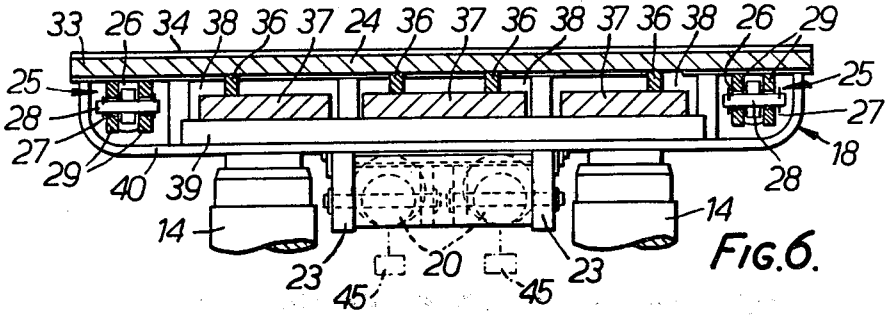

One way of carrying out the invention is described in detail below with reference to drawings which illustrate one specific embodiment, of which FIG. 1 is a side elevation of a roof support suitable for use in mines in accordance with the invention, FIG. 2 is a side elevation of a part of the construction shown in FIG. 1, FIG. 3 is a view taken in the direction of the arrow III on FIG. 2 and with the cantilever member shown detached from the remainder of the structure, FIG. 4 is a cross-section taken along the line IV—IV on FIG. 3 but with the cantilever member in a partially-extended position, FIG. 5 is a cross-section taken along the line V—V on FIG. 3, and, FIG. 6 is a cross-section taken along the line VI—VI on FIG. 2.

In the drawings a roof support for use in a mine for supporting the mine roof during mineral-mining operations comprises a floor-engaging structure in the form of a floor beam 12, a roof-engageable member which includes a canopy 13 and prop means in the form of a plurality of extendable and contractible hydraulically-operable props 14 which act between the floor beam and the canopy for adjustably urging the canopy into engagement with the mine roof.

At the rearward end portion of the floor beam 12, that is to the right in FIG. 1, a pivotal guide linkage 15 is provided which is connected to a goaf shield 16. This shield is pivotally connected at 17 to the rearward end portion of the canopy 13.

An extension member 18, which also forms part of the roof-engageable member, is pivotally connected at 19 to the forward end portion of the canopy and is capable of being urged into supporting engagement with the mine roof by a pair of hydraulically-operable capsules 20, the piston rods 21 of which are pivotally connected at 22 to brackets 23 carried on the underside of member 18.

The roof support also includes a cantilever member 24 which is extendable and retractable with respect to the extension member 18 of the canopy 13 by actuator means in the form of a pair of hydraulic telescopic jacks 25. The cylinder 26 of each jack is mounted in a respective zone 27 in the structure of the cantilever member adjacent a side thereof, being pivotally connected as at 28 to a respective pair of lugs 29 fast with the forward end portion of the cantilever member. The piston rod 30 of each jack is pivotally connected, as at 31, to a member 32, adjacent the pivotal connection 19, the member 32 being fast with the canopy 13.

The cantilever member 24 includes a flat plate 33 which has a roof-engageable surface 34 and which is curved downwardly at its forward edge, this plate being slidably engageable with the flat roof-engageable surface 35 of the extension member 18. The surfaces 34 and 35 are of the same transverse width, or substantially so.

Spacer members 36 are welded to the underside of the plate 33, and three rigid elements in the form of tongue members 37 are welded to these spacer members, being thereby spaced from the plate 33. These tongue members are parallel with the plate 33 and are of substantially the same length as the plate. The spacer members 36 extend from the forward end of the cantilever member for approximately a third of the length of the tongue members.

The tongue members are received in respective compartments 38 formed in the extension member 18, a transversely-disposed plate 39 being welded to the forward extremity of the base 40 of the member 18 and transversely-disposed plates 41 being welded to the upper wall 42 which itself forms a cover member of the member 18 and which overlies the compartments 38. The plates 39 and 41 form bearings for supporting the tongue members 37 in their sliding movement.

When it is required to extend the cantilever member 24 with respect to the extension member 18 either fully or partially, the jacks 25 are caused to extend and the tongue members 37 slide on the bearing plates 39, 41, while the plate 33 slides on the upper surface 35 of the extension member, the surface 34 then effectively forming an extension of the surface 35 and having the full transverse width thereof.

For retraction of the cantilever member the jacks 25 are contracted and sliding movement of the cantilever member in the rearward direction away from the mineral face takes place until the end faces 43 of the spacer members 36 come into engagement with the plates 41, whereupon the cantilever member is fully retracted.

The tongue members 37 and the plate 33 of the cantilever member are of steel, as are the base 40, the upper wall 42 of the extension member 18 and the longitudinal members 44 thereof which in part define the compartments 38, the longitudinal members 44 being secured, in parallel manner, both to the base 40 and the cover member (upper wall 42) to define therewith a plurality of the elongate compartments extending lengthwise of the cover member. The cover member and the base are common to all of the elongate compartments. The modulus of elasticity of the material of these parts is such, and the cantilever member and the associated extension member structure are so designed, that a relatively stiff roof-supporting arrangement is provided. The provision of jacks with their cylinders disposed adjacent the edges of the cantilever member results in a compact operating construction contributing also to the overall stiffness of the arrangement.

Since the cantilever member and its supporting extension member are much stiffer than has been the case hitherto, it is no longer necessary to rely on the inherent bending characteristics of the cantilever member itself to afford yieldability in the event of the roof loads exceeding a predetermined value. Instead yield valves, shown diagrammatically at 45, are provided in association with the capsules 20, these valves being set to open when the roof load becomes sufficiently high as to cause the liquid pressure generated within the capsules to exceed a predetermined value. Thus, yielding can take place before the occurrence of any significant bending in the structure of the cantilever member itself and thus without subjecting this structure to undesirable stress which could otherwise lead eventually to structural weakness and possible mechanical failure.

With the construction above described smooth sliding movement during extension and retraction of the cantilever member is provided. Further, by so arranging for the tongue members each to be accommodated in respective compartments and for the roof-engageable plate of the cantilever member to be in direct sliding engagement with the upper surface of the extending member, ingress of debris, which might otherwise give rise to impeding of the sliding movement, is resisted. Also the construction is such that its overall depth is relatively small thereby providing desired compactness. Hence the construction is relatively light in weight and not unwieldy.

By the invention since a relatively rigid cantilever member is provided it is possible, with that member extended or partially extended, for the roof support to be advanced with the member actually subjected to an appreciable amount of roof loading, or for the cantilever member itself to be extended while subjected to such loading.

The invention is in no way limited in its application to mine roof supports of the shield type such as in the embodiment above-described with reference to the drawings, as in other embodiments it is with advantage applied to other forms of roof support for use in mines, or again to supports for use in other fields.

Although in the embodiment above described with reference to the drawings the cantilever member is carried by an extension member which is itself pivotally connected to the roof-engageable canopy, in other embodiments of the invention the cantilever member may be so arranged as to be supported directly by the canopy, which then alone forms the roof-engageable member, and to be retractable and extendable directly with respect thereto.

Further, although in the embodiment above described with reference to the drawings the roof-engageable surface of the cantilever member is of the same transverse width, or substantially so, as that of the extension member, in other embodiments of the invention it may be of appreciably greater transverse width than the roof-engageable surface of the extension member or roof-engageable member.

Finally, although in the embodiment above described with reference to the drawings the said elongate compartments have been provided in the roof-engageable member and said elongate elements, together with the associated roof-engageable plate, have been formed with the cantilever member, in alternative embodiments of the invention the converse may be the case so that the compartments are provided in the cantilever member and said elements, together with the associated plate, are formed with the roof-engageable member.

I claim:

1. A roof support suitable for use in mines including a roof-engageable member and a cantilever member, one of these two members comprising a base, a cover member providing a roof-engageable surface, and a plurality of longitudinal members secured, in parallel manner, both to said base and said cover member, whereby said base, cover member and longitudinal members together form a plurality of parallel elongate compartments extending in the lengthwise direction of the cover member, and the other of said two members including a plurality of parallel and rigid elongate elements slidably fitting into said compartments and joined together at least at their end portions remote from said one member, said other member also including a plate, having a roof-engageable surface, which defines the profile in plan of that member and which is so secured to said elements, in parallel relation therewith, as to be relatively slidable upon and with respect to said roof-engageable surface of said cover member, the transverse widths of said surfaces being such that when said roof-engageable member and said cantilever member are caused by actuator means relatively to slide from a retracted condition to an extended condition, or to a partially-extended condition, one of said roof-engageable surfaces effectively forms a full width extension of the other of said roof-engageable surfaces.

2. A roof support as claimed in claim 1, wherein said one member having a plurality of parallel elongate compartments forms said roof-engageable member and said other member having a plurality of parallel and rigid elongate elements forms said cantilever member.

3. A roof support as claimed in claim 1, wherein said actuator means comprise at least one hydraulic telescopic jack pivotally connected to said roof-engageable member and to said cantilever member.

4. A roof support as claimed in claim 3, wherein two of said telescopic jacks are provided and disposed in parallel relation one with respect to the other.

5. A roof support as claimed in claim 4, wherein the cylinders of said jacks are each mounted in a respective zone in the structure of said cantilever member adjacent a respective side thereof.

6. A roof support as claimed in claim 1, wherein said roof-engageable member includes a canopy and an extension member pivotally connected to said canopy, said extension member having said plurality of parallel elongate compartments extending in the lengthwise direction thereof.

7. A roof support as claimed in claim 6, wherein said extension member and said cantilever member are capable of being together urged into supporting engagement with a mine roof by hydraulically-operable means suitably pivotally connected to said canopy and to said extension member.

8. A roof support as claimed in claim 1, wherein the base and cover member are common to all of the elongate compartments.

9. A roof support as claimed in claim 8, wherein a plate is secured to, and disposed transversely of, the upper surface of the free end portion of said base and a further plate is secured to, and disposed transversely of, the lower surface of said cover member at a desired distance from the free end portion thereof, said parallel and rigid elongate elements being in slidable engagement with said plates.

* * * * *